US010236136B1

(12) United States Patent
Fasano

(10) Patent No.: US 10,236,136 B1
(45) Date of Patent: Mar. 19, 2019

(54) ARRANGEMENT FOR DOUBLE BREAK CONTACT WITH ELECTRO-MAGNETIC ARC-BLOW

(71) Applicant: Carling Technologies, Inc., Plainville, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 15/904,335

(22) Filed: Feb. 24, 2018

(51) Int. Cl.
*H01H 9/44* (2006.01)
*H01H 1/20* (2006.01)

(52) U.S. Cl.
CPC ..... *H01H 9/446* (2013.01); *H01H 1/2066* (2013.01)

(58) Field of Classification Search
CPC ..... H01H 9/446; H01H 9/40; H01H 9/443; H01H 50/041; H01H 50/20; H01H 50/44; H01H 51/22; H01H 51/28; H01H 51/29; H01H 2051/2218; H01H 1/2066; H01H 71/24; H01H 71/0235; H01H 71/2481
USPC ..... 218/22, 28, 27, 30, 23; 200/42.01; 335/60, 88, 107, 127, 136, 149, 180
See application file for complete search history.

(56) References Cited

U.S. PATENT DOCUMENTS 1,019,425 A * 3/1912 Cubitt ..... H01H 50/88 335/158
1,560,553 A * 11/1925 Evans ..... H01H 9/44 218/22
1,700,910 A * 2/1929 Seaberg ..... H01H 51/086 335/136
1,923,092 A * 8/1933 Horst ..... H01H 73/50 218/28
2,492,300 A * 12/1949 Lewis ..... B60M 1/18 191/39
9,748,061 B2 * 8/2017 Katzensteiner .... H01H 71/2409

* cited by examiner

*Primary Examiner* — Edwin A. Leon
*Assistant Examiner* — William A Bolton
(74) *Attorney, Agent, or Firm* — Forge IP, PLLC

(57) ABSTRACT

A high voltage switch system including a circuit interrupter having a first set of contacts in series with a first coil, which are in series with a second coil and a second set of contacts, the first coil wound around a first core and the second coil wound around a second coil such that upon an arc forming between the contacts of the first and second contacts, the arcs are motivated in opposite directions to be extinguished.

22 Claims, 3 Drawing Sheets

ARRANGEMENT FOR DOUBLE BREAK CONTACT WITH ELECTRO-MAGNETIC ARC-BLOW

FIELD OF THE INVENTION

The invention relates to a circuit interrupter used for high voltage applications, and more specifically, the invention relates to a circuit interrupter that includes high voltage circuit interrupting capacity and arc motivation.

BACKGROUND OF THE INVENTION

Circuit interrupters are electrical components that are used to open an electrical circuit, interrupting the flow of current. A basic example of a circuit interrupter is a switch, which generally consists of two electrical contacts in one of two states; either closed, meaning that the contacts are in electrical contact with each other allowing electricity to flow between them, or open, meaning that the contacts are not in electrical contact with each other preventing the flow of electricity. A switch may be directly manipulated to provide a control signal to a system, such as a computer keyboard button, or to control power flow in a circuit, such as a light switch.

Another example of a circuit interrupter is a circuit breaker. A circuit breaker may be used, for example, in an electrical panel to limit the amount of current flowing through the electrical wiring. A circuit breaker is designed to protect an electrical circuit from damage caused by, for example, an overload, a ground fault or a short circuit. If a fault condition, such as a power surge occurs in the electrical wiring, the breaker will trip. This will cause a breaker that was in an "on" position to flip to an "off" position and interrupt the flow of electrical power through the breaker. Circuit breakers are generally provided to protect the electrical wiring by limiting the amount of current transmitted through the wires to a level that will not damage them. Circuit breakers can also prevent destruction of the devices that may draw too much current.

A standard circuit breaker has a terminal connected to a source of electrical power, such as a power line electrically connected to the secondary of a power company transformer, and a second terminal electrically connected to the wires that the breaker is intended to protect. Conventionally, these terminals are referred to as the "line" and "load" respectively. The line is sometimes referred to as the input of the circuit breaker. The load is sometimes referred to as the output of the circuit breaker, which connects to the electrical circuit and components receiving the electrical power.

A circuit breaker can be used as a replacement for a fuse. Unlike a fuse however, which typically operates to open in an over current situation and then must be replaced; a circuit breaker can be "reset" (either manually or automatically) to resume operation.

In general, a single pole circuit interrupter has two contacts positioned inside of a housing. The first contact is stationary and may be connected to either the line or the load. The second contact is movable with respect to the first contact, such that when the circuit breaker is in the "off" or "tripped" position, a gap exists between the first and second contact.

A problem with the above-described circuit interrupters arises when energized contacts are opened while under load. As the contacts separate, transitioning from a closed to an open position, or when the opposite occurs, an electric arc may be formed in the gap between the contacts. An electrical arc is a plasma discharge between two points that is caused by electrical current that ionizes gasses in the air between the two points. This can become a very serious issue in high voltage applications. High voltage applications typically are associated with high power transfer and therefore, the switching devices used in these applications must be able to effectively and safely switch even under load.

The creation of an arc during transition of the contacts can result in undesirable effects that negatively affect the operation of the circuit interrupter, even potentially creating a safety hazard. These negative effects can also have adverse consequences on the functioning of the circuit interrupter.

One possible consequence is that the arc may short to objects inside the circuit interrupter and/or to surrounding objects, causing damage and presenting a potential fire or safety hazard.

Another consequence of arcing is that the arc energy damages the contacts themselves, causing some material to escape into the air as fine particulate matter. The debris that has been melted off of the contacts can migrate or be flung into the mechanism of the circuit interrupter, destroying the mechanism or reducing its operational lifespan.

Still another effect of arcing is due to the extremely high temperature of the arc (tens of thousands of degrees Celsius), which can impact the surrounding gas molecules creating ozone, carbon monoxide, and other dangerous compounds. The arc can also ionize surrounding gasses, potentially creating alternate conduction paths.

Because of these detrimental effects it is very important to quickly suppress or quench the arc to prevent the above-described situations.

SUMMARY OF THE INVENTION

What is desired then is a circuit interrupter that is adapted for use with high voltage applications and quickly suppresses an arc that forms between the contacts.

It is further desired to provide a circuit interrupter that can be used in high voltage applications and in polarity sensitive applications.

It is still further desired to provide a circuit interrupter that can be used in high voltage applications that minimizes the formation of an arc forming between the contacts.

These and other objection are achieved by the provision of a circuit interrupter that includes a first stationary contact and a first moveable contact forming a first set of contacts and a second stationary contact and a second moveable contact, forming a second set of contacts. The first and second moveable contact are mechanically interlocked such that they move simultaneously. The circuit interrupter also includes a first winding wrapped around a first core and a second winding wrapped around a second core. The first core has a first end and a second end and the second core has a first end and a second end. The first end of the first core and the first end of the second core are position in the vicinity of the first set of contacts. The second end of the first core and the second end of the second core are position in the vicinity of the second set of contacts.

The circuit interrupter further includes a line connection adapted to be connected to a source of electrical power and a load connection adapted to be connected to a load to receive the electrical power. The line connection is electrically connected to the first moveable contact. The first stationary contact is electrically connected to a first end of the first winding. while a second end of the first winding is electrically connected to a second end of the second winding. A first end of the second winding is electrically connected to the second movable contact, while the second stationary contact is electrically connected to the load connection.

In operation, when the first and second moveable contacts are in a closed position relative to the first and second stationary contacts, electrical power is transferred through the first and second windings, which functions to generate magnetic fields in the vicinity of the first and second sets of contacts. These magnetic fields will function to drive any arc that may form between either of the sets of contacts toward the ends of the either the first or second cores where the arc(s) can be extinguished.

In one configuration, it is contemplated that the first and second moveable contacts can be mounted onto a common moveable member to form a bridge contact arraignment.

In another configuration, additional systems for arc suppression and arc quenching can be used including vents may be provided along a portion of the housing to allow gas and debris that may develop due to an arc(s) to be vented out of the housing.

It is further contemplated that an arc quenching plate may be positioned at the ends of each of the first and second cores. For example, the first end of the first core could include a first arc plate that is positioned on a lateral side of the first core and extends toward the first set of contacts. Likewise, the second end of the first core could include a second arc plate that is positioned on a lateral side of the first core and extends toward the second set of contacts. The second core could be provided with first and second arc plates that extend toward the first and second sets of contacts respectively. These plates can be positioned so as to quench any arc that may develop between the high voltage contact surfaces when the contacts are opened under load.

For this application the following terms and definitions shall apply:

The term "network" as used herein includes both networks and internetworks of all kinds, including the Internet, and is not limited to any particular network or inter-network.

The terms "first" and "second" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

For purposes of this application, the term "high" voltage is applied to applications in which a voltage higher than that used for power distribution. The lower limit is usually taken as 8,700V according to the National Electrical Safety Code (NFPA 70).

In one configuration a high voltage circuit interrupter is provided comprising a first stationary contact electrically connected to a line terminal and a first moveable contact adapted to be moved into contact with the first stationary contact, the first stationary and moveable contacts forming a first set of contacts. The circuit interrupter further comprises a first core and a first winding having a first end and a second end, the first winding wrapped around the first core. The circuit interrupter is provided such that the first end of the first winding is electrically connected to the first moveable contact. The circuit interrupter also comprises a second stationary contact and a second moveable contact adapted to be moved into contact with the second stationary contact, the second stationary and moveable contacts forming a second set of contacts. The circuit interrupter still further comprises a second core and a second winding having a first end and a second end where the second winding is wrapped around the second core. The circuit interrupter is provided such that the second end of the first winding is electrically connected to the second end of the second winding and the first end of the second winding is electrically connected to the second moveable contact. The circuit interrupter is further provided such that the second stationary contact is electrically connected to a load terminal and the first moveable contact is mechanically connected to the second moveable contact where the first and second sets of contacts open and close simultaneously.

In another configuration a method for suppressing an arc in a high voltage circuit interrupter is provided comprising the steps of connecting a first moveable contact to a line terminal, connecting a first stationary contact to a first end of a first winding and connecting a second end of the first winding to a second end of a second winding. The method further comprises the steps of connecting a second end of the second winding to a second moveable contact and connecting a second stationary to a load terminal. The method still further comprises the steps of positioning the first winding around a first core, positioning the second winding around a second core and mechanically connecting the first and second moveable contacts such that the first and second moveable contacts move simultaneously.

Other objects of the invention and its particular features and advantages will become more apparent from consideration of the following drawings and accompanying detailed description.

DETAILED DESCRIPTION OF THE INVENTION

Figure 1:
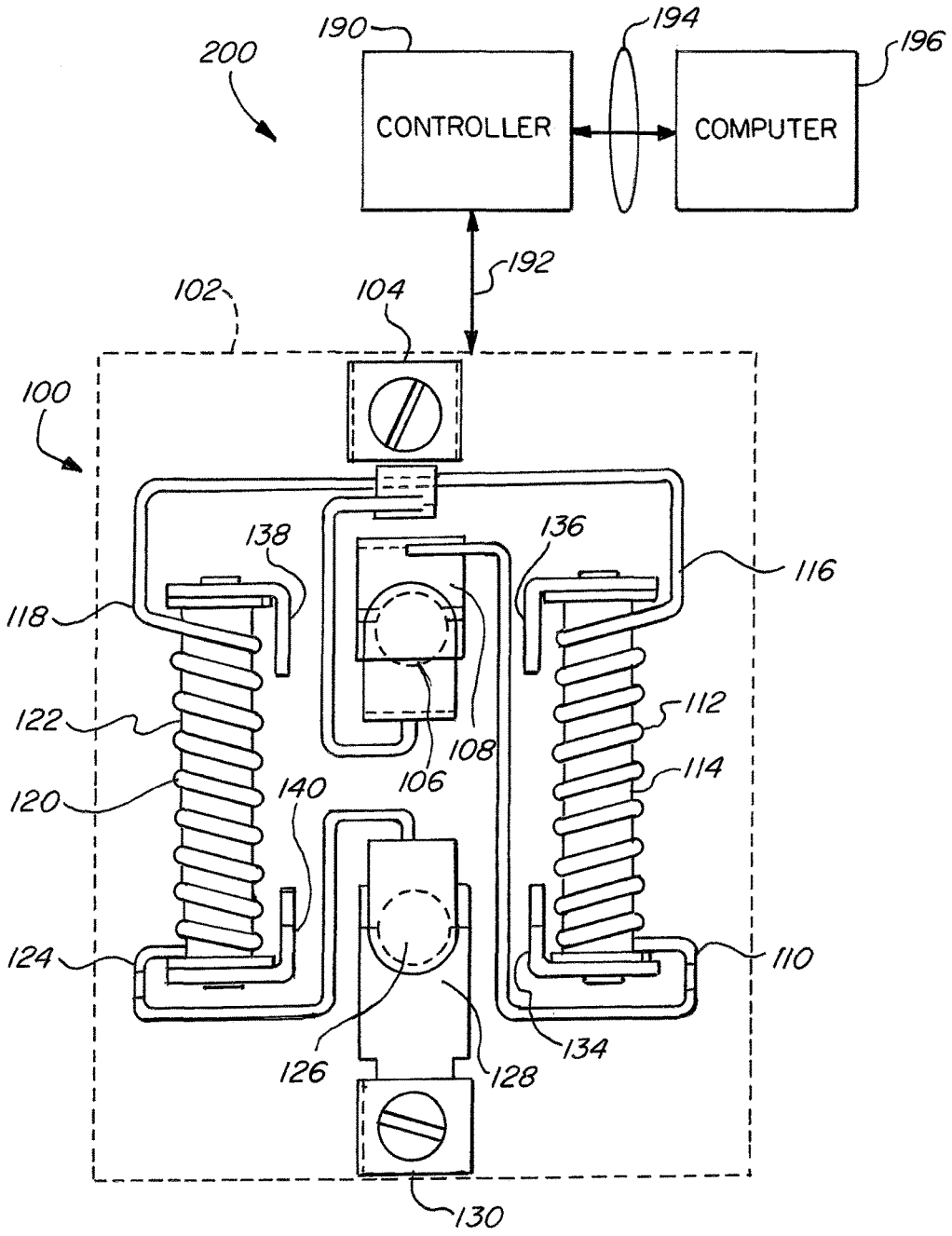
FIG. 1 is an illustration of a high voltage switching system including a top view of one configuration of the high voltage circuit interrupter.

Referring now to the drawings, wherein like reference numerals designate corresponding structure throughout the views.

Figure 2:
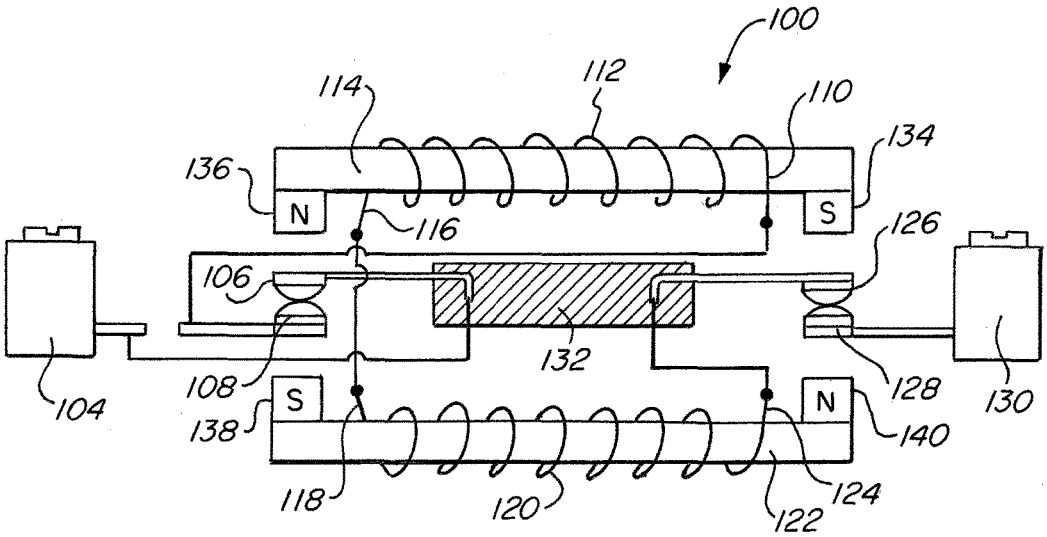
FIG. 2 is side view of certain elements of the circuit interrupter according to FIG. 1.

Reference is now made to FIGS. 1 and 2 where FIG. 1 is provides a view of high voltage switching system 200 including a top view of circuit interrupter 100. FIG. 2 provides a side view of certain elements of circuit interrupter 100.

The circuit interrupter 100 includes a housing 102 within which the working elements are maintained. The circuit interrupter 100 includes a line terminal 104, which is adapted to be connected to a source of electrical power (not shown). Line terminal 104 is electrically connected to a first moveable contact 106. Also provided is a first stationary contact 108, which together with the first moveable contact 106 form a first set of contacts.

The first stationary contact 108 is electrically connected to a second end 110 of a first winding 112, which is wrapped around a first core 114. A second end 116 of the first winding 112 is electrically connected to a second end 118 of a second winding 120 that is wrapped around a second core 122. A first end 124 of the second winding 120 is electrically connected to a second moveable contact 126. A second stationary contact 128 is electrically connected to a load terminal 130, which is adapted to be connected to a load (not shown). The second moveable contact 126 together with the second stationary contact 128 form a second set of contacts.

It will be understood by those of skill in the art that the line terminal 104 could be electrically connected to either of the first moveable contact 106 or the first stationary contact 108. Likewise, the load terminal 130 could be electrically connected to either of the second moveable contact 126 or the second stationary contact 128.

The first and second moveable contacts 106, 126 are mechanically interlocked such that they move simultaneously. In the configuration illustrated in FIG. 2, the first and second moveable contacts 106, 126 are connected by a bridge 132. The bridge 132 may be connected to an actuation mechanism (not shown), which would function to move the bridge 132 in a linear manner to open and close the first and second sets of contacts.

While not illustrated in the figures, it is contemplated that circuit interrupter 100 could be provided with an overcurrent measurement system that would function to automatically open the contacts in the event of an overcurrent situation as is known in the art.

In particular, however, it will be noted that the transmission of electrical power through the circuit interrupter 100 travels in a serial manner through the first and second sets of contacts. This is advantageous for high voltage applications because the voltage that will develop across each of the sets of contacts is half the total system voltage. This lower voltage development across each of the sets of contacts will result in smaller arcs developing between the contacts. As the first moveable contact 106 will move simultaneously with second moveable contact 126, the breaking of the first and second sets of contacts will occur simultaneously.

In addition to circuit interrupter 100 high voltage switching system 200 includes a controller 190, which is depicted in FIG. 1 connected to circuit interrupter 100 via a communication line 192. Controller 190 can comprise any type of controller used for controlling the switching of circuit interrupter 100. Controller 190 is further connected to a remote computer 196 via a network connection 194. This allows for remote monitoring of a status of the circuit interrupter 100 as well as for transmission of control signals for controlling the circuit interrupter 100.

Also depicted in FIG. 2 is first plate 134 and second plate 136 that are coupled to a lateral side of first core 114 at the first and second ends respectively. Also shown are first plate 140 and second plate 138 that are coupled to a lateral side of second core 122. As depicted in FIG. 2, the first plate 134 forms a magnetized south pole whereas second plate 136 forms a magnetized north pole. Likewise, the second plate 138 forms a magnetized south pole whereas second plate 140 forms a magnetized north pole.

Figure 3:
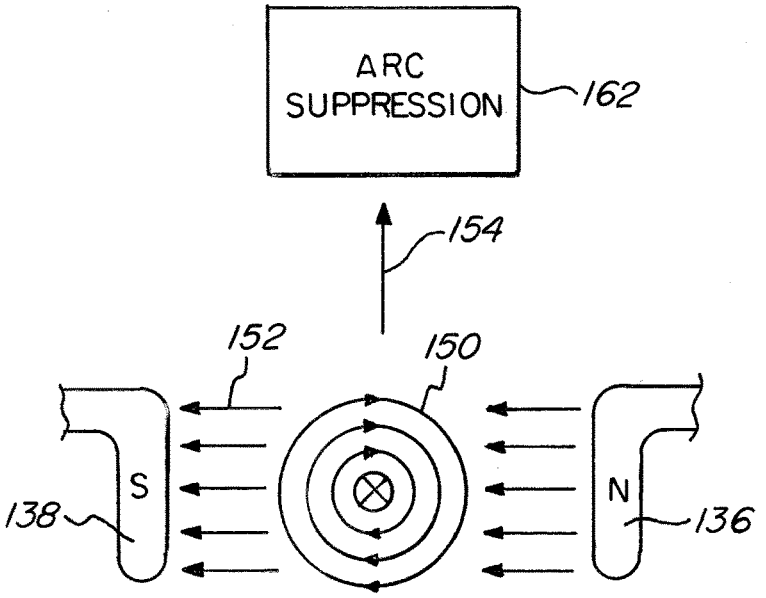
FIG. 3 is top view illustration of the first sets of contacts according to FIG. 2 and the generation of an electric and a magnetic field that surrounds the first set of contacts when electrical power is passing through the first set of contacts.
Figure 4:
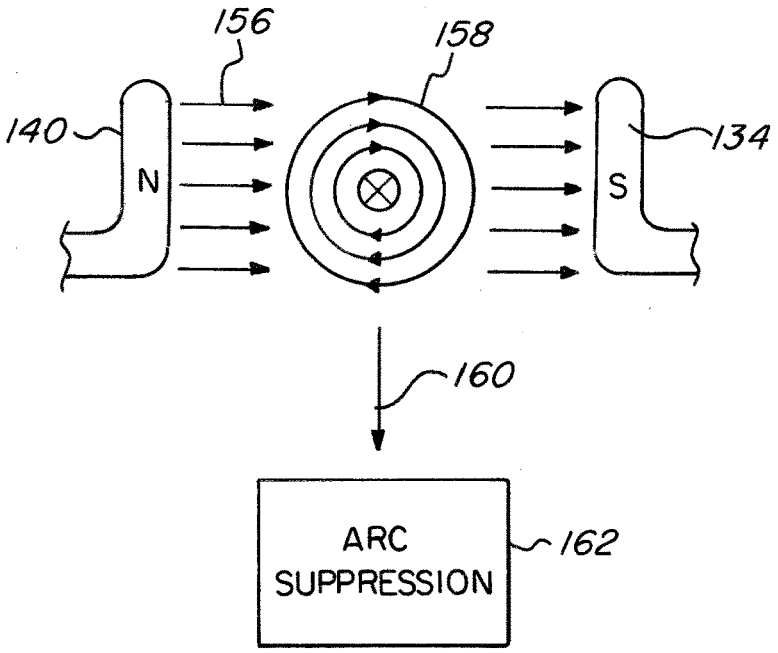
FIG. 4 is top view illustration of the second sets of contacts according to FIG. 2 and the generation of an electric and a magnetic field that surrounds the second set of contacts when electrical power is passing through the second set of contacts.

Turning to FIGS. 3 and 4 the function of the magnetized poles can be seen acting on an arc that may develop between the first and second sets of contacts.

FIG. 3 depicts second plate 136 and second plate 138, which produce a magnetic field 152 therebetween and illustrated with arrows moving from the north pole towards the south pole. The set of contacts is situated in the middle of the magnetic field where an electric field 150 is formed based on the flow of electricity through the set of contacts. The electric field 150 interacts with the magnetic field 152 such that an arc that may be formed is urged toward direction 154.

FIG. 4 depicts first plate 134 and first plate 140, which produce a magnetic field 156 therebetween and illustrated with arrows moving from the north pole towards the south pole. The set of contacts is situated in the middle of the magnetic field 156 where an electric field 158 is formed based on the flow of electricity through the set of contacts. The electric field 158 interacts with the magnetic field 156 such that an arc that may be formed is urged toward direction 160, which is opposite direction 154.

Also shown in FIGS. 3 and 4 is arc suppression 162, which may comprise any type of arc suppression system as known in the art. For example, arc suppression 162 may comprise a series of vertically stacked plates that are provided adjacent to the sets of contacts. In certain configurations, multiple arc suppression devices may be provided where the plates are U-shaped having legs extending toward the set of contacts they are provided to protect from arcing.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A high voltage circuit interrupter comprising:

a first stationary contact electrically connected to a line terminal;

a first moveable contact adapted to be moved into contact with said first stationary contact, said first stationary and moveable contacts forming a first set of contacts;

a first core;

a first winding having a first end and a second end, said first winding wrapped around said first core;

said first end of said first winding electrically connected to said first moveable contact;

a second stationary contact;

a second moveable contact adapted to be moved into contact with said second stationary contact, said second stationary and moveable contacts forming a second set of contacts;

a second core;

a second winding having a first end and a second end, said second winding wrapped around said second core;

said second end of said first winding electrically connected to said second end of said second winding;

said first end of said second winding electrically connected to said second moveable contact;

said second stationary contact electrically connected to a load terminal;

wherein said first moveable contact is mechanically connected to said second moveable contact such that said first and second sets of contacts open and close simultaneously.

2. The high voltage circuit interrupter according to claim 1 wherein said first core comprises a first end and a second end and said second core comprises a first and second end, said circuit interrupter further comprising:

a first pole piece positioned at the first end of said first core;

a second pole piece positioned at the second end of said first core;

a third pole piece positioned at the first end of said second core; and a fourth pole piece positioned at the second end of said second core.

3. The high voltage circuit interrupter according to claim 2 wherein said first, second, third and fourth pole pieces comprise an L-shaped device.

4. The high voltage circuit interrupter according to claim 3 wherein said first pole piece and said second pole piece extends on a lateral side of said first core and said third pole piece and said fourth pole piece extends on a lateral side of said second core.

5. The high voltage circuit interrupter according to claim 4 wherein said circuit interrupter is adapted to be used with DC voltage.

6. The high voltage circuit interrupter according to claim 5 wherein when the first and second sets of contacts are in a closed position, said first pole piece is configured with a south pole magnetization and said second pole piece is configured with a north pole magnetization; and said third pole piece is configured with a south pole magnetization and said fourth pole piece is configured with a north pole magnetization.

7. The high voltage circuit interrupter according to claim 6, wherein when an arc develops between the first set of contacts, the arc is urged in a direction that is parallel to surfaces of said first and second pole pieces; and wherein when an arc develops between the second set of contacts, the arc is urged in a direction that is parallel to surfaces of said third and fourth pole pieces.

8. The high voltage circuit interrupter according to claim 1 further comprising a housing within which the first and second sets of contacts are contained.

9. The high voltage circuit interrupter according to claim 1 wherein said first and second cores comprise magnetically permeable material.

10. The high voltage circuit interrupter according to claim 1 further comprising a controller for controlling switching of said first and second set of contacts.

11. The high voltage circuit interrupter according to claim 10 further comprising a network connection adapted to allow a remote computer to monitor a status and control switching of said first and second set of contacts.

12. The high voltage circuit interrupter according to claim 1 further comprising an arc suppressor adapted to receive and quench an arc that develops between the first moveable contact and the first stationary contact.

13. The high voltage circuit interrupter according to claim 12 wherein said arc suppressor is adapted to receive and quench an arc that develops between the second moveable contact and the second stationary contact.

14. A method for suppressing an arc in a high voltage circuit interrupter comprising the steps of:

connecting a first moveable contact to a line terminal;

connecting a first stationary contact to a first end of a first winding;

connecting a second end of the first winding to a second end of a second winding;

connecting a second end of the second winding to a second moveable contact;

connecting a second stationary to a load terminal;

positioning the first winding around a first core;

positioning the second winding around a second core;

mechanically connecting the first and second moveable contacts such that the first and second moveable contacts move simultaneously.

15. The method according to claim 14 wherein the first core includes a first end and a second end and the second core includes a first and second end, the method further comprising the steps of:

positioning a first pole piece at the first end of the first core;

positioning a second pole piece at the second end of the first core;

positioning a third pole piece at the first end of the second core; and positioning a fourth pole piece at the second end of the second core.

16. The method according to claim 15 wherein said first, second, third and fourth pole pieces are provided as L-shaped devices.

17. The method according to claim 16 further comprising the steps of:

positioning the first pole piece and the second pole piece to extend along a lateral side of the first core; and positioning the third pole piece and the fourth pole piece to extend along lateral side of the second core.

18. The method according to claim 17 wherein the circuit interrupter is adapted to be used with DC voltage.

19. The method according to claim 18 further comprising the steps of:

urging an arc that develops between the first moveable and stationary contacts in a first direction that is parallel to surfaces of the first and second pole pieces; and urging an arc that develops between the second moveable and stationary contacts in a second direction that is parallel to surfaces of the third and fourth pole pieces.

20. The method according to claim 19 wherein the first direction is opposite to the second direction.

21. The method according to claim 14 further comprising the steps of:

connecting a controller to the circuit interrupter; and switching the first and second set of contacts between an open and a closed state with the controller.

22. The method according to claim 21 further comprising the steps of:

connecting the controller to a network connection;

monitoring a status of the first and second set of contacts; and transmitting control signals to the controller via the network connection.

* * * * *